US011316286B2

(12) United States Patent
Feng et al.

(10) Patent No.: US 11,316,286 B2
(45) Date of Patent: Apr. 26, 2022

(54) ELECTRICAL CONNECTOR

(71) Applicant: DONGGUAN LUXSHARE PRECISION INDUSTRY CO. LTD., Dongguan (CN)

(72) Inventors: Yun Feng, Dongguan (CN); ZhiYong Li, Dongguan (CN); ZhongYuan Lai, Dongguan (CN)

(73) Assignee: DONGGUAN LUXSHARE PRECISION INDUSTRY CO. LTD., Dongguan (CN)

( * ) Notice: Subject to any disclaimer, the term of this patent is extended or adjusted under 35 U.S.C. 154(b) by 31 days.

(21) Appl. No.: 16/921,472

(22) Filed: Jul. 6, 2020

(65) Prior Publication Data

US 2021/0226350 A1 Jul. 22, 2021

(30) Foreign Application Priority Data

Jan. 21, 2020 (CN) ..... 202020138701.2

(51) Int. Cl.
*H01R 4/04* (2006.01)
*H01R 13/405* (2006.01)
*H01R 24/60* (2011.01)

(52) U.S. Cl.
CPC ..... *H01R 4/04* (2013.01); *H01R 13/405* (2013.01); *H01R 24/60* (2013.01)

(58) Field of Classification Search
CPC .. H01R 43/24; H01R 13/405; H01R 13/6658; H01R 43/04; H01R 24/60
USPC ..... 439/606, 76.1
See application file for complete search history.

(56) References Cited

U.S. PATENT DOCUMENTS 3,573,345 A * 4/1971 Devries ..... H05K 3/363 174/254
3,991,463 A 11/1976 Squitieri et al.
8,282,412 B1 * 10/2012 Yaguchi ..... H01R 13/5804 439/492
8,932,074 B2 * 1/2015 Jenrich ..... H01R 4/04 439/371
9,040,839 B2 * 5/2015 Furuta ..... H05K 3/361 174/260
9,113,586 B2 8/2015 Lee et al.
(Continued)

*Primary Examiner* — Gary F Paumen
(74) *Attorney, Agent, or Firm* — Birch, Stewart, Kolasch & Birch, LLP

(57) ABSTRACT

The present disclosure provides an electrical connector comprising an electrical connector body, a conductive adhesive layer, and a connecting cable. The electrical connector body comprises a plurality of electrical connecting conductors. The conductive adhesive layer covers the plurality of electrical connecting conductors. The connecting cable comprises a plurality of cables. One end of each of the cables comprises a conductive pin. The conductive pin of each of the cables is disposed on the conductive adhesive layer. The conductive pin of each of the cables forms an electrical connection path with the corresponding electrical connecting conductor. The plurality of electrical connection paths is individually separated. By combining the conductive pins of each cable with the electrical connecting conductors of the electrical connector body through a conductive adhesive layer, an electrical connection path could be formed to bond the connecting cable and the electrical connector body without any existing soldering process.

10 Claims, 8 Drawing Sheets

(56) References Cited

U.S. PATENT DOCUMENTS

| | | | | |
|---|---|---|---|---|
| 9,615,477 | B2 | 4/2017 | Ling | |
| 2008/0023214 | A1* | 1/2008 | Kuo | H05K 3/363<br>174/117 FF |
| 2011/0217877 | A1* | 9/2011 | Linz | H01R 12/59<br>439/625 |
| 2013/0045647 | A1* | 2/2013 | Jenrich | H05B 3/86<br>439/884 |
| 2013/0337688 | A1* | 12/2013 | Zong | H01R 13/665<br>439/620.21 |
| 2014/0073185 | A1* | 3/2014 | Siahaan | H01R 13/504<br>439/607.58 |
| 2016/0013581 | A1* | 1/2016 | Wu | H01R 13/5845<br>439/452 |
| 2016/0079689 | A1* | 3/2016 | Wu | B23K 26/22<br>439/581 |

* cited by examiner

ELECTRICAL CONNECTOR

CROSS REFERENCE TO RELATED APPLICATION

This applications claims the priority benefit of Chinese Patent Application Serial Number CN202020138701.2, filed on Jan. 21, 2020, the full disclosure of which is incorporated herein by reference.

BACKGROUND

Technical Field

The present disclosure relates to the technical field of electrical connector, and more particularly to an electrical connector having cable and connector head bonded by conductive adhesive layer and forming an electrical connection between the cable and an electric connector body.

Related Art

Conventional electrical connectors are majorly assembled by manual soldering; therefore, the personnel cost would take a large proportion of the manufacturing cost of electrical connectors. Additional cost for current techniques of the soldering also includes materials such as soldering electrodes. Poor soldering of bridging or wicking between the pad and the pin often occurs in the existing soldering process having low controllability.

SUMMARY

The embodiments of the present disclosure provide an electrical connector having cable and connector head bonded by conductive adhesive layer, intended to solve the issue of cost and poor soldering of current soldering techniques.

The present disclosure provides an electrical connector comprising an electrical connector body, a conductive adhesive layer, and a connecting cable. The electrical connector body comprises a plurality of electrical connecting conductors. The conductive adhesive layer covers the plurality of electrical connecting conductors. The connecting cable comprises a plurality of cables. One end of each of the cables comprises a conductive pin. The conductive pin of each of the cables is disposed on the conductive adhesive layer. The conductive pin of each of the cables forms an electrical connection path with the corresponding electrical connecting conductor. The plurality of electrical connection paths is individually separated.

The embodiments of the present disclosure could solve the issue of cost and poor soldering of current soldering techniques by bonding the conductive pin of each cable of the connecting cable to the electrical connecting conductor of the electrical connector body through the conductive adhesive layer to form the electrical connection path, such that each cable of the connecting cable could be connected to the electrical connector body by the conductive adhesive layer without existing soldering process.

It should be understood, however, that this summary may not contain all aspects and embodiments of the present invention, that this summary is not meant to be limiting or restrictive in any manner, and that the invention as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
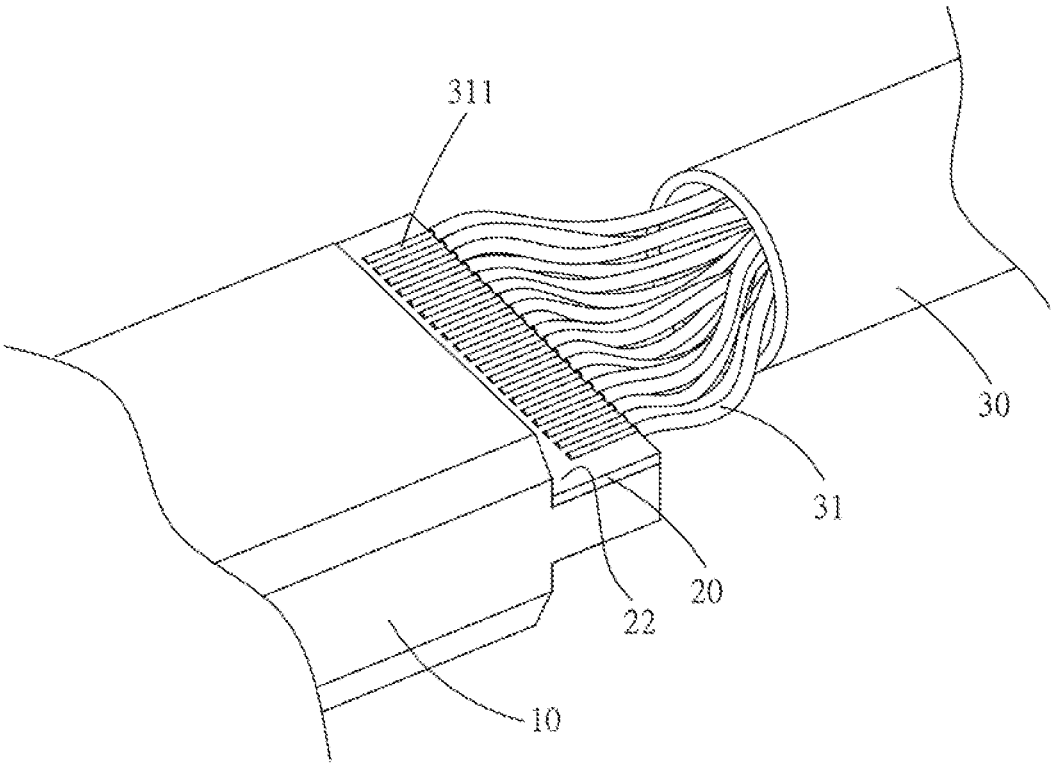
FIG. 1 is a schematic diagram of an electrical connector of the first embodiment of the present disclosure.

The present invention will now be described more fully hereinafter with reference to the accompanying drawings, in which exemplary embodiments of the invention are shown. This present invention may, however, be embodied in many different forms and should not be construed as limited to the embodiments set forth herein. Rather, these embodiments are provided so that this present invention will be thorough and complete, and will fully convey the scope of the present invention to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the invention. This description is made for the purpose of illustration of the general principles of the invention and should not be taken in a limiting sense. The scope of the invention is best determined by reference to the appended claims.

Moreover, the terms "include", "contain", and any variation thereof are intended to cover a non-exclusive inclusion. Therefore, a process, method, object, or device that comprises a series of elements not only include these elements, but also comprises other elements not specified expressly, or may include inherent elements of the process, method, object, or device. If no more limitations are made, an element limited by "include a/an . . . " does not exclude other same elements existing in the process, the method, the article, or the device which comprises the element.

In the following embodiment, the same reference numerals are used to refer to the same or similar elements throughout the invention.

Figure 2:
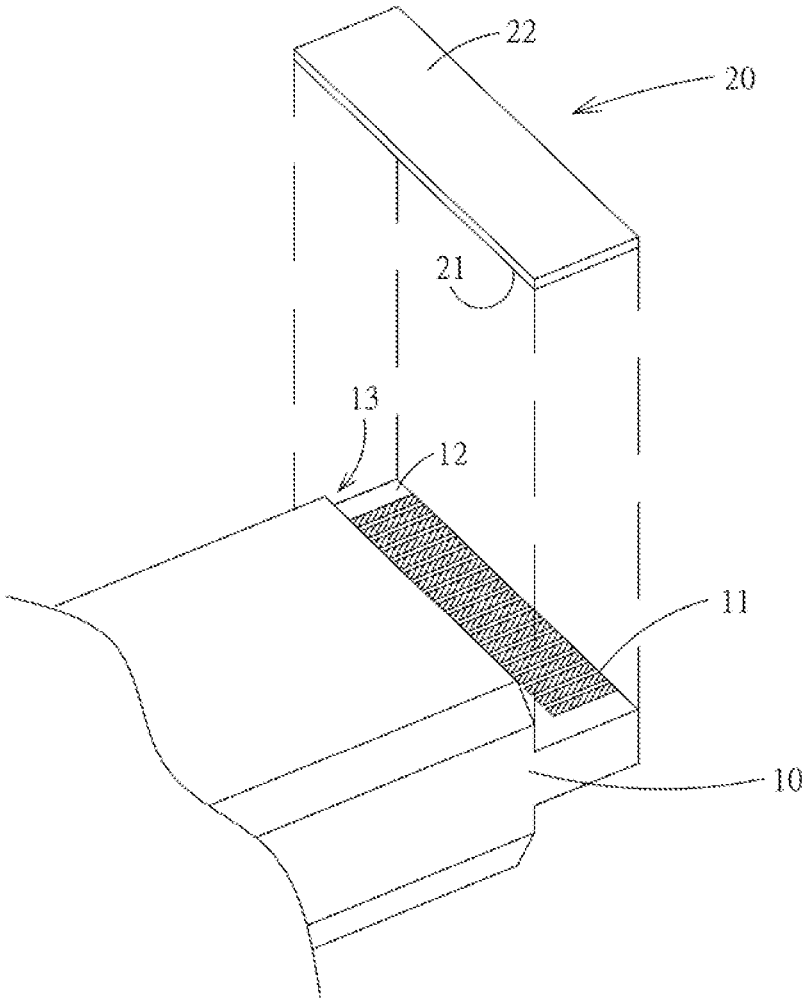
FIG. 2 and FIG. 3 are schematic diagrams of the manufacturing process of the electrical connector of the first embodiment of the present disclosure.
Figure 3:
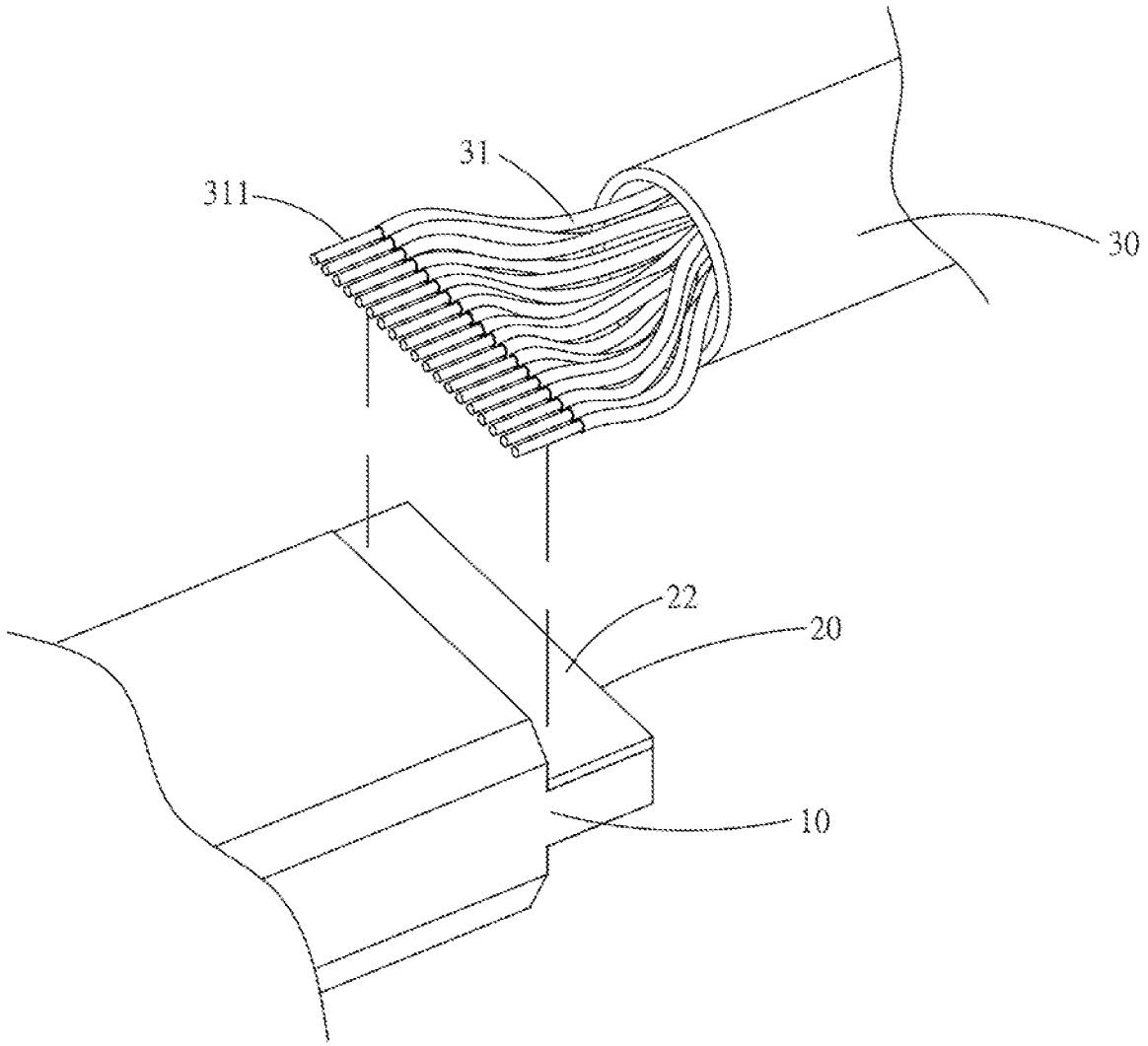

FIG. 1, FIG. 2 and FIG. 3 are schematic diagrams of an electrical connector and the manufacturing process of the electrical connector of the first embodiment of the present disclosure. As shown in the figures, the electrical connector 1 of this embodiment comprises an electrical connector body 10, a conductive adhesive layer 20, and a connecting cable 30. The electrical connector body 10 comprises a plurality of electrical connecting conductors 11. The conductive adhesive layer 20 covers the plurality of electrical connecting conductors 11. The connecting cable 30 comprises a plurality of cables 31. One end of each of the cables 31 comprises a conductive pin 311. The conductive pin 311 of each of the cables 31 is disposed on the conductive adhesive layer 20. The conductive pin 311 of each of the cables 31 forms an electrical connection path with the corresponding electrical connecting conductor 11. The electrical connection paths are individually separated. Each of the cables 31 of the connecting cable 30 forms a mechanical connection with the electrical connector body 10 through the conductive adhesive layer 20. As the electrical connection path could be formed between the conductive pin 311 of each of the cables 31 of the connecting cable 30 and the corresponding electrical connecting conductor 11 through the conductive adhesive layer 20, the electrical connection between the connecting cable 30 and the electrical connector body 10 can be realized.

Refer to FIG. 2, the electrical connector body 10 comprises an attaching surface 12. The electrical connecting conductors 11 are disposed on the attaching surface 12 at intervals. The conductive adhesive layer 20 is disposed on the attaching surface 12 and covers the plurality of electrical connecting conductors 11. In one embodiment, a recess 13 is formed on the electrical connector body 10. The recess 13 receives the conductive pins 311 of the connecting cable 30. In this embodiment, the attaching surface 12 is a bottom surface of the recess 13 and is a flat surface. In this embodiment, the plurality of electrical connecting conductors 11 is disposed on the attaching surface 12. The electrical connecting conductors 11 are parallel to each other and are individually separated at equal intervals. The plurality of electrical connecting conductors 11 is electrically connected to respective electrical connecting terminals of the interface O of the electrical connector body 10 (see FIG. 10). The electrical connecting terminals are parallel to each other and are individually separated at equal intervals, and can be secured to the electrical connector body 10 by injection molding, embedding, etc. One end of each of the electrical connecting terminals is the corresponding electrical connecting conductor 11 and the other end extends into the interface O. In this embodiment, the plurality of electrical connecting conductors 11 extends to and is arranged on an edge of the attaching surface 12, that is, the plurality of electrical connecting conductors 11 extends to and is arranged on an edge of the electrical connector body 10. However, the present disclosure is not limited to this. In another embodiment, the plurality of electrical connecting conductors 11 may keep a distance from the edge of the attaching surface 12.

Refer to FIG. 3, the conductive adhesive layer 20 is coated or disposed on the attaching surface 12. The conductive adhesive layer 20 comprises a first surface 21 and a second surface 22 opposite to the first surface 21 in a vertical direction perpendicular to the attaching surface 12. The first surface 21 contacts the plurality of electrical connecting conductors 11. In some embodiments, the conductive adhesive layer 20 is soft or flexible. A part of the electrical connecting conductor 11 protrudes from the attaching surface 12. The electrical connecting conductor 11 would press the first surface 21 of the conductive adhesive layer 20 so that the pressed portion of the first surface 21 would be recessed inward. The part of the first surface 21 that is not in contact with the electrical connecting conductor 11 would be in contact with the attaching surface 12. As shown in FIG. 3, the conductive pin 311 of each of the cables 31 of the connecting cable 30 is disposed on the second surface 22 so that the second surface 22 would be in contact with the plurality of conductive pins 311, and each of the conductive pins 311 would be electrically connected to the corresponding electrical connecting conductor 11 in the vertical direction of the attaching surface 12 through the conductive adhesive layer 20. In this embodiment, the positions of the plurality of conductive pins 311 of the connecting cable 30 on the second surface 22 and the plurality of electrical connecting conductors 11 of the electrical connector body 10 are in a one-to-one correspondence in the vertical direction of the attaching surface 12. In the vertical direction of the attaching surface 12, the plurality of electrical connecting conductors 11 and the corresponding conductive pins 311 can form the electrical connection paths that are electrically insulated from each other and are perpendicular to the attaching surface 12 by pressing the electrical connector body 10, the conductive adhesive layer 20, and the plurality of conductive pins 311 of the connecting cable 30 in the vertical direction of the attaching surface 12. The conductive adhesive layer 20 may be an anisotropic conductive adhesive (ACF) provided with a plurality of conductive particles in the adhesive material thereof. The conductive particles can be pushed in a pressing direction (a direction perpendicular to the attaching surface 12) to be contacted with each other by pressing in the direction perpendicular to the attaching surface 12, thereby achieving the electrical connection.

Figure 4:
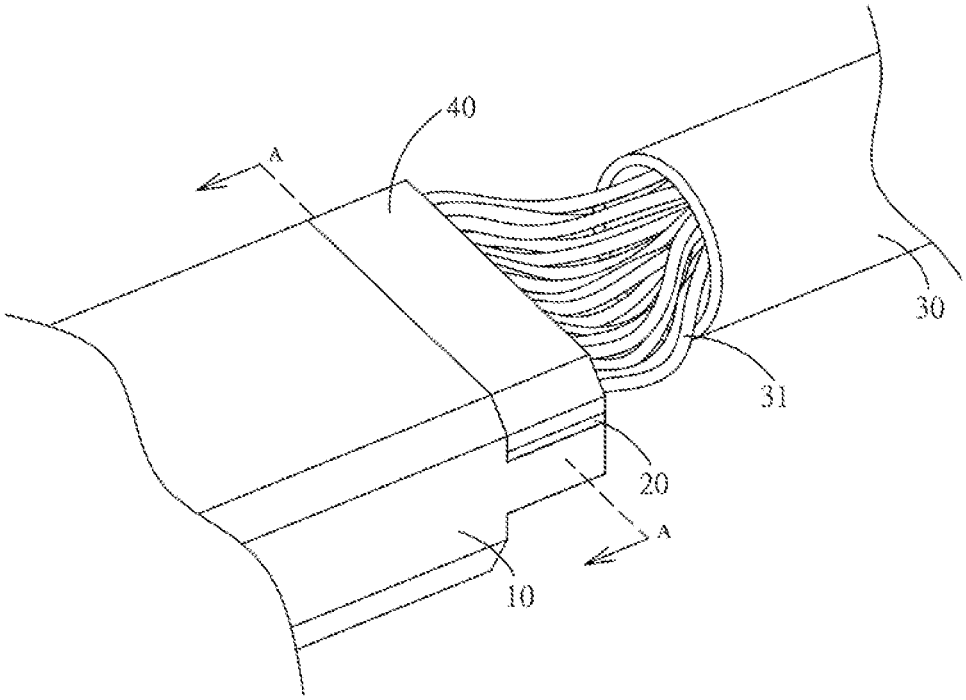
FIG. 4 is a schematic diagram of the electrical connector of the second embodiment of the present disclosure.
Figure 5:
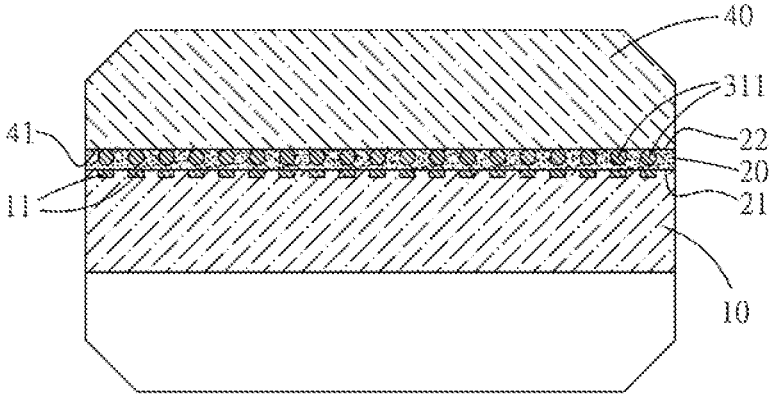
FIG. 5 is a cross-sectional view along the A-A direction in FIG. 4.
Figure 6:
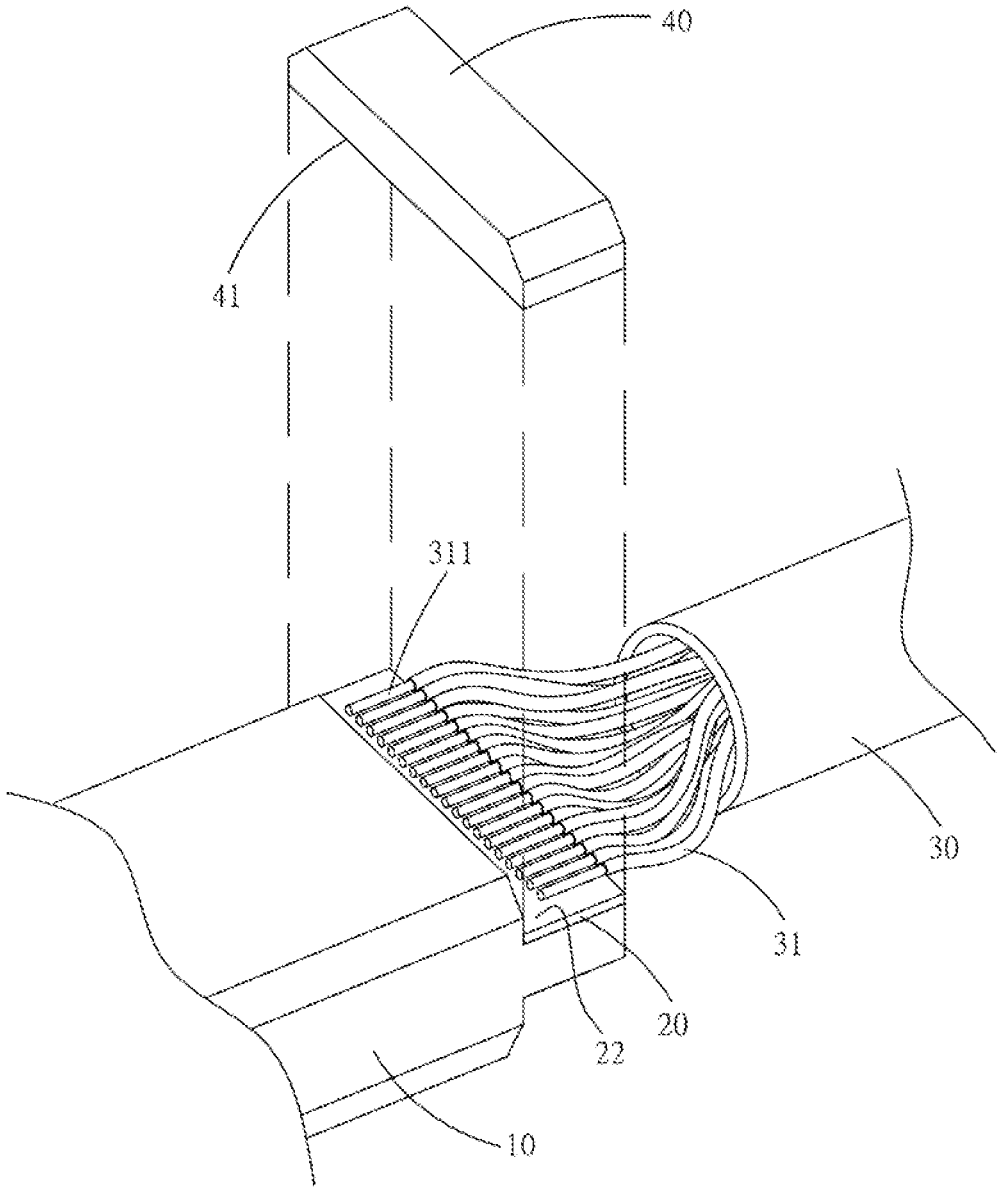
FIG. 6 is an exploded view of the electrical connector of the second embodiment of the present disclosure.

FIG. 4 is a schematic diagram of the electrical connector of the second embodiment of the present disclosure. FIG. 5 is a cross-sectional view along the A-A direction in FIG. 4. FIG. 6 is an exploded view of the electrical connector of the second embodiment of the present disclosure. In this embodiment, the steps of the coating or disposing of the conductive adhesive layer 20 on the attaching surface 12, the placing of the conductive pins 311 of each of the cables 31 of the connecting cable 30 on the second surface 22 and the pressing to the conductive adhesive layer 20 (also can be heated at the same time, but not limited to this) are identical to the those of the first embodiment. In this embodiment, the electrical connector also comprises a pressing component 40. The plurality of conductive pins 311 of the connecting cable 30 is disposed between the pressing component 40 and the conductive adhesive layer 20. The pressing component 40 presses the plurality of conductive pins 311, the conductive adhesive layer 20, and the plurality of electrical connecting conductors 11 in the vertical direction of the attaching surface 12. After the plurality of conductive pins 311 of the connecting cable 30 are in contact with the second surface 22 of the conductive adhesive layer 20, the pressing component 40 is placed into the recess 13 of the electrical connector body 10 and presses the plurality of conductive pins 311 of the connecting cable 30. Thus, the conductive pins 311 are pressed into the conductive adhesive layer 20. Finally, the pressing component 40 abuts against the plurality of conductive pins 311 of the connecting cable 30 and the second surface 22 of the conductive adhesive layer 20. The pressing component 40 presses the plurality of electrical connecting conductors 11 through the conductive adhesive layer 20. In this embodiment, the pressing component 40 is a plate-shaped member and comprises a pressing surface 41. The plurality of conductive pins 311 is disposed between the pressing surface 41 and the conductive adhesive layer 20. The pressing surface 41 is opposite to the attaching surface 12. In some embodiment, the pressing component 40 causes the conductive pins 311 to press the second surface 22 of the conductive adhesive layer 20, and the pressed portion of the second surface 22 is recessed inward. The portion of the second surface 22 that is not in contact with the conductive pins 311 will contact the pressing surface 41. In this embodiment, the shape of the pressing component 40 can match the shape of the recess 13 of the electrical connector body 10, so that the outline of the pressing component 40 and the electrical connector body 10 are consistent after the pressing component 40 is mounted to the recess 13. The pressing surface 41 faces the second surface 22 of the conductive adhesive layer 20. The pressing surface 41 abuts against the plurality of conductive pins 311 of the connecting cable 30 and the second surface 22 of the conductive adhesive layer 20.

FIG. 5 is a cross-sectional view along the A-A direction in FIG. 4. As shown in the figure, the pressing surface 41 of the pressing component 40 is a flat surface. In addition, the pressing surface 41 is parallel to the attaching surface 12 of the electrical connector body 10. The pressing surface 41 can be completely pressed against the second surface 22 of the conductive adhesive layer 20. The plurality of conductive pins 311 of the connecting cable 30 is completely buried in the conductive adhesive layer 20. The plurality of conductive pins 311 respectively corresponds to the plurality of electrical connecting conductors 11 of the electrical connector body 10 in the direction perpendicular to the attaching surface 12. The electrical connection patha are formed by each of the conductive pins 311 with the corresponding electrical connecting conductor 11 in the direction perpendicular to the attaching surface 12 through the conductive adhesive layer 20. Thus, in a direction other than that is perpendicular to the attaching surface 12, electrical insulation occurs between each of the electrical connection paths. For example, electrical insulation occurs between the electrical connection paths in a direction parallel to the attaching surface 12.

Figure 7:
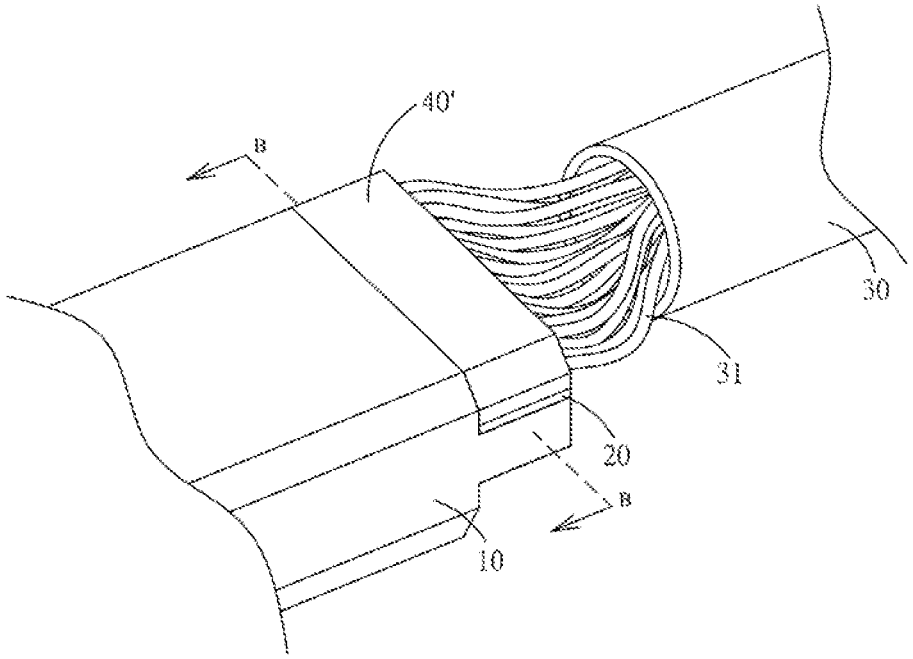
FIG. 7 is a schematic diagram of the electrical connector of the third embodiment of the present disclosure.
Figure 8:
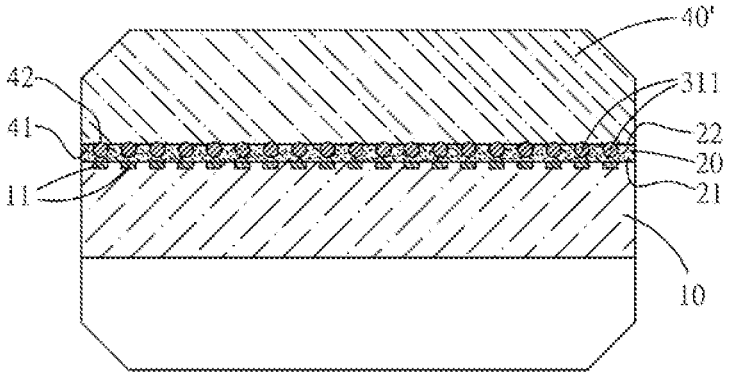
FIG. 8 is a cross-sectional view along the B-B direction in FIG. 7.
Figure 9:
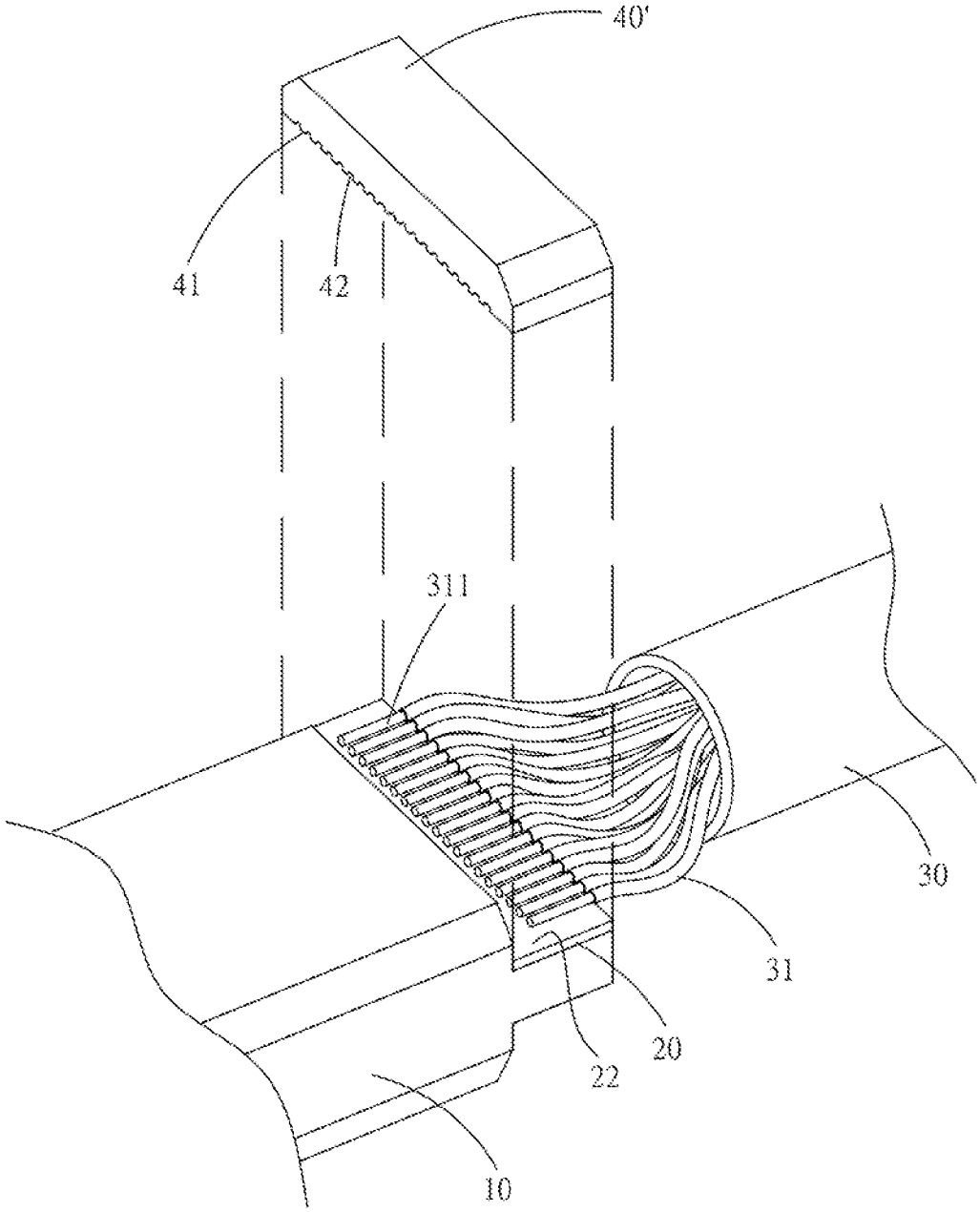
FIG. 9 is an exploded view of the electrical connector of the third embodiment of the present disclosure.

FIG. 7 is a schematic diagram of the electrical connector of the third embodiment of the present disclosure. FIG. 8 is a cross-sectional view along the B-B direction in FIG. 7. FIG. 9 is an exploded view of the electrical connector of the third embodiment of the present disclosure. In this embodiment, a plurality of interval-arranged electrical connecting conductors 11 is provided on the attaching surface 12 of the electrical connector body 10. The conductive adhesive layer 20 is coated or disposed on the attaching surface 12. The steps and configurations of placing the plurality of conductive pins 311 of the connecting cable 30 on the second surface 22 of the conductive adhesive layer 20 are the same as those of the first embodiment. Thus, identical components are given the same reference characters and descriptions would be omitted. The pressing component 40' of this embodiment comprises a plurality of guiding grooves 42 on the pressing surface 41. Each of the guiding grooves 42 respectively receives a part of the corresponding conductive pins 311. In this embodiment, the plurality of guiding grooves 42 is arranged parallel to each other and corresponds to the extension direction and the arrangement of the electrical connecting conductors 11 on the attaching surface 12. When the pressing surface 41 of the pressing component 40' of this embodiment is pressed against the plurality of conductive pins 311 of the connecting cable 30, the plurality of guiding grooves 42 on the pressing surface 41 plays a role in positioning the plurality of conductive pins 311. In this way, the plurality of conductive pins 311 would correspond to the electrical connecting conductors 11 of the attaching surface 12. In addition, the guiding groove 42 may be provided with an appropriate depth. In this embodiment, the depth of the guiding groove 42 is ⅕ of the diameter of the conductive pin 311. The guiding groove 42 can receive the top edge portion of the conductive pin 311 so that the top edge portion of the conductive pin 311 and the corresponding guide groove 42 can be matched and positioned with each other. In this way, the bottom edge portion of the conductive pin 311 can be aligned with the corresponding electrical connecting conductor 11 in the vertical direction of the attaching surface 12. In another embodiment, the depth of the guiding groove 42 may be equal to the radius of the conductive pin 311.

Figure 10:
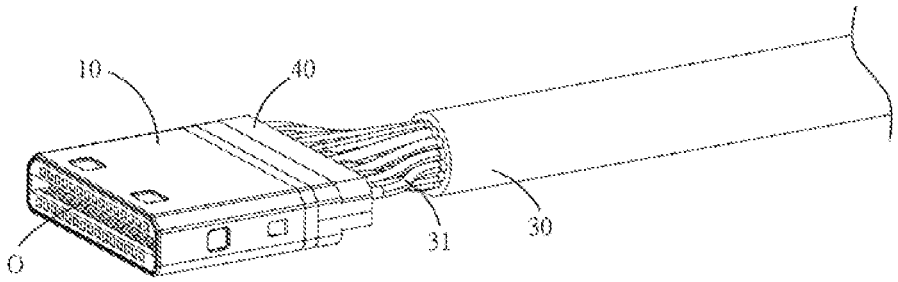
FIG. 10 to FIG. 12 are schematic diagrams of the forming of an inner mold injection part and an insulation covering part of the electrical connector of the fourth embodiment of the present disclosure.
Figure 11:
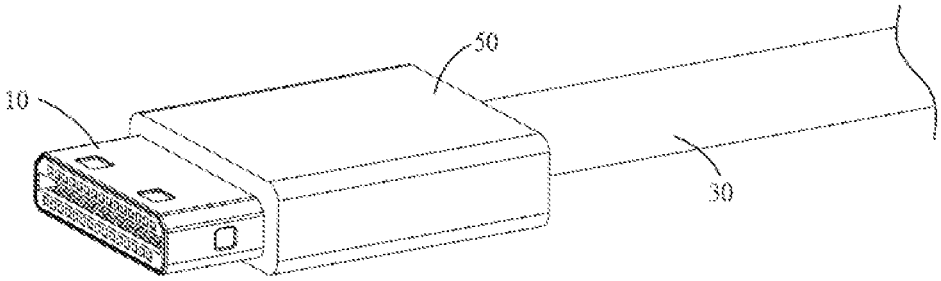
Figure 12:
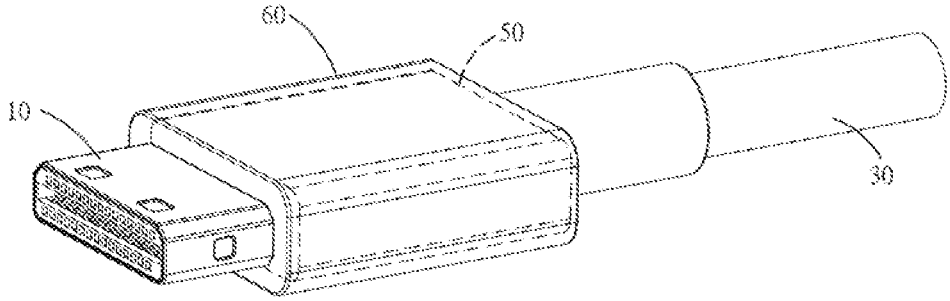

FIG. 10 to FIG. 12 are schematic diagrams of the forming of an inner mold injection part and an insulation covering part of the electrical connector of the fourth embodiment of the present disclosure. As shown in the figures, the electrical connector further comprises an inner mold injection part 50 and an insulation covering part 60. The inner mold injection part 50 covers the joint of the plurality of cables 31 and the electrical connector body 10. The insulation covering part 60 covers a part of the electrical connector body 10, the inner mold injection part 50, and a part of the cable 31. The inner mold injection part 50 is formed by inner-mold injecting the assembly in which the connecting cable 30 is coupled to the electrical connector body 10 through the conductive adhesive layer 20. The inner mold injection part 50 covers the joint of the connecting cable 30 and the electrical connector body 10. In this embodiment, the inner-mold injection part 50 completely covers the pressing component 40, the cables 31 and the conductive pins 311 exposed from the connecting cable 30, the conductive adhesive layer 20 and the recess 13 of the electrical connector body 10. The inner-mold injection part 50 also covers a part of the connecting cable 30 close to the electrical connector body 10, thereby stabilizing the connection between the aforementioned components and improving the integrity. In addition, the insulation covering part 60 is provided at the outside of the inner mold injection part 50, and the insulation covering part 60 covers the entire inner mold injection part 50. The insulation covering part 60 covers a part of the electrical connector body 10 as a gripping portion for user insertion and removal. The insulation covering part 60 covers a part of the connecting cable 30 close to the inner mold injection part 50 as a component for stress relief when the connecting cable 30 is pulled or bent.

In summary, the present disclosure provides embodiments of the electrical connector. The conductive pins of each of the cables of the connecting cable can be bonded with the electrical connector body through the conductive adhesive layer without the need of high-temperature soldering to reduce the labor and material cost and to avoid the issue of poor soldering of bridging and wicking.

It is to be understood that the term "comprises", "comprising", or any other variants thereof, is intended to encompass a non-exclusive inclusion, such that a process, method, article, or device of a series of elements not only include those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present invention has been explained in relation to its preferred embodiment, it does not intend to limit the present invention. It will be apparent to those skilled in the art having regard to this present invention that other modifications of the exemplary embodiments beyond those embodiments specifically described here may be made without departing from the spirit of the invention. Accordingly, such modifications are considered within the scope of the invention as limited solely by the appended claims.

What is claimed is:

1. An electrical connector, comprising:

an electrical connector body comprising a plurality of electrical connecting conductors;

a conductive adhesive layer covering the plurality of electrical connecting conductors; and a connecting cable comprising a plurality of cables; one end of each of the cables comprising a conductive pin; the conductive pin of each of the cables being disposed on the conductive adhesive layer; the conductive pin of each of the cables forming an electrical connection path with the corresponding electrical connecting conductor; the electrical connection paths being individually separated;

wherein the electrical connector body comprises an attaching surface on which the electrical connecting conductors are disposed, and the electrical connector further comprises a pressing component; the plurality of conductive pins is disposed between the pressing component and the conductive adhesive layer; the pressing component presses the plurality of conductive pins, the conductive adhesive layer and the plurality of electrical connecting conductors in the vertical direction of the attaching surface.

2. The electrical connector according to claim 1, wherein the electrical connecting conductors are disposed on the attaching surface at intervals; the conductive adhesive layer is disposed on the attaching surface; the conductive adhesive layer covers the plurality of electrical connecting conductors.

3. The electrical connector according to claim 2, wherein the plurality of electrical connection paths is perpendicular to the attaching surface.

4. The electrical connector according to claim 2, wherein the conductive adhesive layer comprises a first surface and a second surface opposite to the first surface in a vertical direction perpendicular to the attaching surface; the first surface contacts the plurality of electrical connecting conductors; the second surface contacts the plurality of conductive pins; each of the conductive pins and the corresponding electrical connecting conductor are electrically connected through the conductive adhesive layer in the vertical direction.

5. The electrical connector according to claim 4 further comprising an inner mold injection part and an insulation covering part; the inner mold injection part covers a joint of the plurality of cables and the electrical connector body; the insulation covering part covers a part of the electrical connector body, the inner mold injection part, and a part of the cable.

6. The electrical connector according to claim 1, wherein the pressing component is plate-shaped with a pressing surface; the plurality of conductive pins is disposed between the pressing surface and the conductive adhesive layer; the pressing surface is opposite to the attaching surface.

7. The electrical connector according to claim 6, wherein the pressing surface is parallel to the attaching surface.

8. The electrical connector according to claim 6, wherein the pressing surface is a flat surface.

9. The electrical connector according to claim 6, wherein the pressing component comprises a plurality of guiding grooves formed on the pressing surface; each of the guiding grooves respectively accommodates the corresponding conductive pin.

10. The electrical connector according to claim 1 further comprising an inner mold injection part and an insulation covering part; the inner mold injection part covers a joint of the plurality of cables and the electrical connector body; the insulation covering part covers a part of the electrical connector body, the inner mold injection part, and a part of the cable.

* * * * *